US006102135A

United States Patent [19]

Shaw

[11] Patent Number: 6,102,135

[45] Date of Patent: Aug. 15, 2000

[54] PORTABLE CORE SAMPLER

[76] Inventor: Neil B. Shaw, 11305 SE. Nancy Rd., Vancouver, Wash. 98664

[21] Appl. No.: 09/044,380

[22] Filed: Mar. 18, 1998

Related U.S. Application Data

[60] Provisional application No. 60/069,218, Dec. 11, 1997.

[51] Int. Cl.[7] ..... E21B 7/26; E21B 11/02; E21B 10/00

[52] U.S. Cl. ..... 175/20; 175/332; 175/337; 175/339

[58] Field of Search ..... 175/327, 333, 175/337, 339, 352, 20, 21, 332

[56] References Cited

U.S. PATENT DOCUMENTS

| | | | |
|---|---|---|---|
| 4,534,231 | 8/1985 | Jonsson et al. | 175/20 |
| 4,667,755 | 5/1987 | Muller et al. | 175/405.1 |
| 4,907,659 | 3/1990 | Ludwig | 175/20 |
| 5,058,688 | 10/1991 | Scott et al. | 175/20 |

*Primary Examiner*—Eileen Dunn Lillis
*Assistant Examiner*—Gary S. Hartmann
*Attorney, Agent, or Firm*—Olson and Olson

[57] ABSTRACT

A portable core sampler includes a portable electric drill having an output rotary shaft connected detachably to a coupler shaft that supports a water swivel which connects a source of water to an axial water delivery passageway in the coupler shaft. The passageway in the coupler shaft communicates with the water delivery passageway in an elongated core sampler tube connected detachably to the coupler shaft, either directly or through one or more spacer tubes, for simultaneous rotation with the coupler shaft. The end of the core sampler tube opposite the coupler shaft includes core cutting elements for cutting core material for collection in the core sampler tube. Water injected into the system assists the cutting elements in cleanly cutting sub-surface materials by removing heat and cuttings. An inner shoulder in the sampler tube supports a core sample in the core sample tube during retraction of the tube assembly from the sub-surface.

4 Claims, 2 Drawing Sheets

PORTABLE CORE SAMPLER

This application claims the benefit of Provisional application Serial No. 60/069,218, filed Dec. 11, 1997.

BACKGROUND OF THE INVENTION

This invention relates to the collection of sub-surface samples of substances, and more particularly to a novel portable tool for the purpose.

Conventional drilling equipment used for penetrating and sampling sub-surface materials for geotechnical and environmental investigations suffers from many limitations. Truck mounted hollow stem auger rigs, long the standard of the industry, cannot be used in many drilling locations such as under overhead utility lines, in road-less places, or inside buildings. They are difficult to keep clean. Hollow stem auger hammer driven samplers often provide poor quality, badly disturbed samples or, in fibrous materials or very hard materials, they often collect no soil sample at all. They are not capable of reliably penetrating many commonly encountered sub-surface materials including massive rock or concrete, boulders, large, hard cobbles, or wood. Even the recently popular direct push hydraulic systems for soil and groundwater sampling, cannot penetrate or sample massive rock, boulders, or cobbles, nor can they be used in locations that are inaccessible to vehicles.

SUMMARY OF THE INVENTION

The portable core sampler of this invention comprises a hollow core bit sampler tube with a diamond crown or tungstan carbide toothed core bit connected at the opposite end to one or more extension tubes the uppermost one of which is coupled to a water swivel which, in turn, is connected to the output rotary shaft of a portable gasoline powered or electric drill.

It is the principal objective of this invention to provide a portable core sampler that overcomes the aforementioned limitations and disadvantages of prior art samplers.

Another objective of this invention is the provision of a portable core sampler of the class described which is sufficiently small and lightweight as to be usable by a single person of average strength to obtain core samples from rock, concrete, wood and other materials.

Still another objective of this invention is to provide a portable core sampler of the class described that is self-contained and therefore is usable in remote locations that are not accessible to conventional samplers of the prior art.

A further objective of this invention is to provide a portable core sampler of the class described which utilizes quick coupling connectors between confronting ends of a plurality of tubular extensions, whereby to facilitate assembly and disassembly with speed and accuracy.

A still further objective of this invention is the provision of a portable core sampler of the class described that is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2:
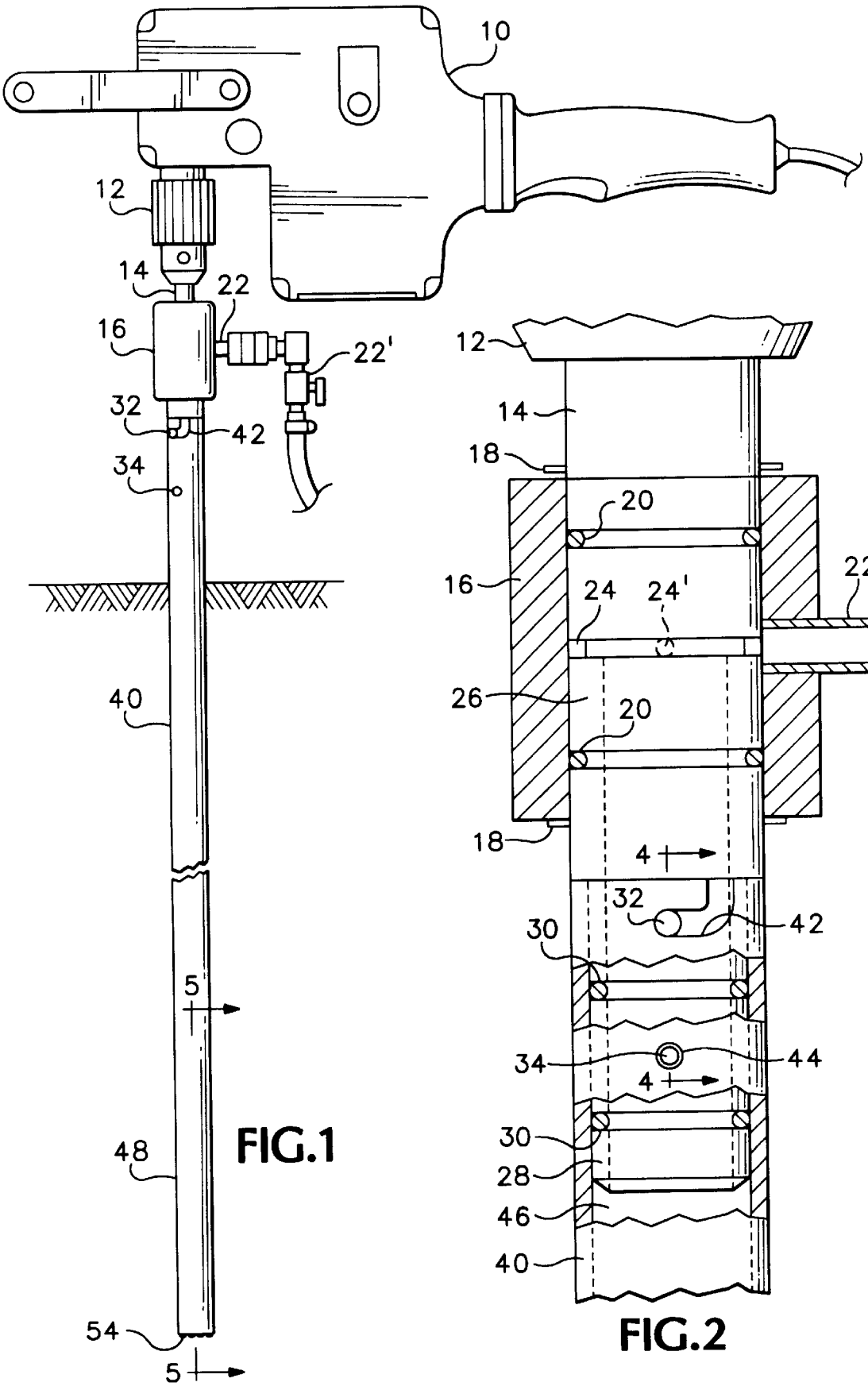
FIG. 1 is a foreshortened vertical elevation of a portable core sampler embodying the featurs of this invention.
FIG. 2 is a fragmentary vertical section, on an enlarged scale, showing internal structural details of the water swivel and tube coupling assemblies.

Referring primarily to FIGS. 1 and 2 of the drawings, the portable core sampler of this invention includes a portable electric motor 10, such as a conventional electric drill motor, the output shaft of which is connected to a chuck 12 by which to make detachable connection to a coupler shaft 14. The coupler shaft extends freely through the annular bore of a water swivel body 16 which is retained on the shaft by means of retainer rings 18. O-rings 20 are mounted in longitudinally spaced annular grooves 24 in the coupler shaft 14 to provide a watertight seal with the water swivel body.

The water swivel body 16 is provided with a water inlet conduit 22 associated with a control valve 22' for controlling the delivery of water from a source (not shown) to the water swivel body. The inner end of the conduit registers with an annular groove 24 in the coupler shaft 14 between the O-rings 20. A radial bore 24' communicates the groove 24 with a longitudinal delivery passageway 26 that extends from the groove 24 to the end of the coupler shaft opposite its connection to the chuck 12.

Figure 4:
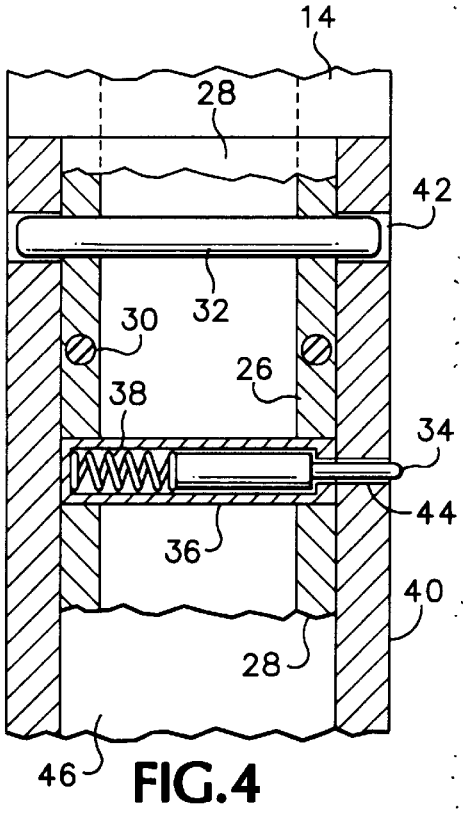
FIG. 4 is a fragmentary sectional view, on an enlarged scale, taken on the line 4—4 in FIG. 2 showing structural details of a spring plunger safety pin for securing tubing sections together in assembled condition.
Figure 6:
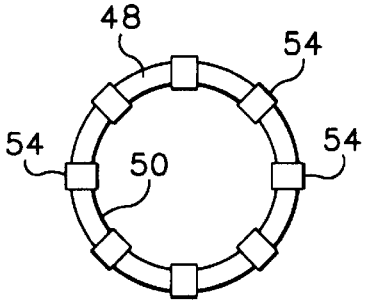
FIG. 6 is an end view of the bottom, core cutting end of the core sampler tube.
Figure 5:
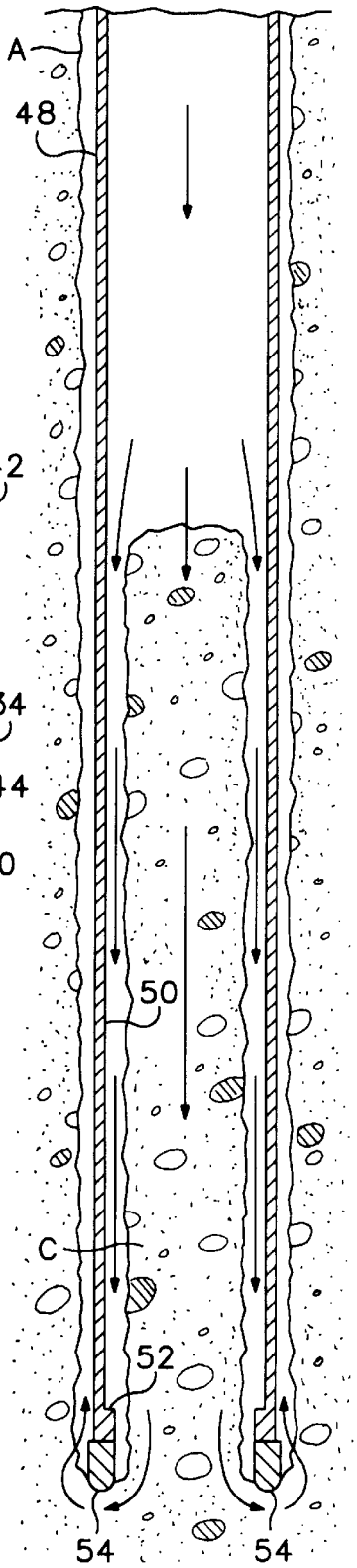
FIG. 5 is a fragmentary vertical section, on an enlarged scale, of the lower portion of the core bit sampler tube, taken on the line 5—5 in FIG. 1.

The outer end portion 28 of the coupler shaft 14 is reduced in diameter and is provided with longitudinally spaced O-ring seals 30. Adjacent the juncture with the large diameter portion 14 the reduced diameter portion is provided with a driver pin 32 which extends across the diameter of the portion 28 and projects outwardly therefrom. Intermediate the O-ring seals 30 a safety pin 34 is mounted retractably in a hollow guide sleeve 36 (FIG. 4) which is secured to and extends diametrically across the portion 28 and delivery passageway 26, parallel to the driver pin 32. The inner section of the safety pin is enlarged in diameter for sliding fit in the sleeve 36, the shoulder between the diameters of the safety pin sections cooperating with the reduced diameter ring at the outer end of the sleeve to limit outward movement of the safety pin. The inner end of the enlarged diameter section of the safety pin abuts one end of a coil spring 38 the opposite end of which abuts the closed end of the sleeve. The coil spring urges the safety pin radially outward relative to the sleeve.

The driver pin 32 and safety pin 34 are arranged for cooperative association with openings in an end portion of an elongated hollow tube. As illustrated in FIG. 2, the tube is identified as a spacer tube 40 and is provided at its upper end with diametrically spaced right angled, bayonet slots 42 for association with driver pin 32 and the radial opening 44 for association with safety pin 34. Thus, the spacer tube is connected to the reduced diameter portion 28 of the coupler shaft 14 by aligning the outer end of the bayonet slots 42 with the projecting ends of driver pin 32 and moving the spacer tube upward to receive the driver pin in the outer end portions of the bayonet slots. The spacer tube then is rotated to move the driver pin into the circumferential portion of the bayonet slots, whereby to lock the spacer tube 40 to the coupler shaft, for simultaneous rotation.

When the driver pin 32 is engaged in the inner ends of the bayonet slots 42, the safety pin 34 registers with the opening 44, whereupon the previously retracted safety pin is projected outwardly, by spring 38, into the opening 44. The safety pin thus insures against inadvertent relative rotation of the spacer tube and coupler shaft. The spacer tube is provided with a longitudinal delivery passageway 46 aligned with passageway 26.

Figure 3:
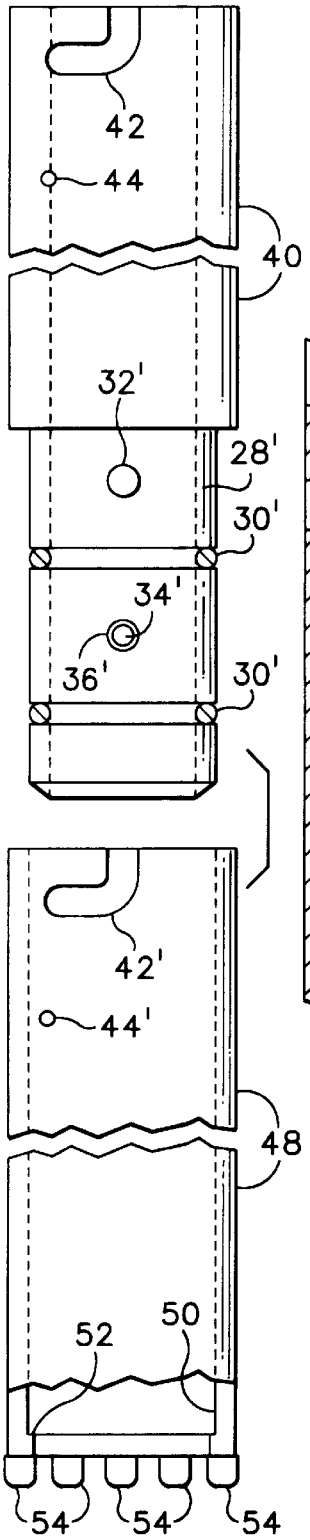
FIG. 3 is a foreshortened exploded vertical elevation, on an enlarged scale, showing the manner of connecting together a plurality of extension tubes interposed between the water swivel and the core bit sampler tube.

As shown in FIG. 3, the spacer tube 40 is provided with a reduced diameter lower end portion identical to the reduced diameter lower end portion 28 of the coupler shaft 14. Accordingly, the same reference numerals are employed, but distinguished by the superscript. This reduced end portion 28' is shown in cooperative arrangement for coupling to the upper end portion of an elongated hollow core bit sampler tube 48, by bayonet slots 42' and safety pin opening 44'.

The core sampler tube 48 is provided with a longitudinal passageway 50 registering with the passageway 46 in spacer tube 40. The bottom end of the tube passageway 50 is reduced in diameter to provide a shoulder 52 which assists in retaining a core sample C within the tube 48. The lower end of the core sampler tube is provided with cutters 54 spaced apart circumferentially to effect cutting through sub-surface rock, soil, wood or other substance. The cutters may be diamond, tungsten carbide, or other suitable substance capable of cutting through the sub-surface materials encountered in core sampling.

It will be appreciated that the core sampler tube 48 may be connected directly to the reduced diameter end portion 28 of coupler shaft 14 when core samplers are to be collected at shallow depths. In the alternative, one or more spacer tubes 40 may be interposed between the coupler shaft 14 and core sampler tube 48 when core samplers are to be collected at greater depths. It has been found convenient to provide the spacer and core sampler tubes in lengths of about 3 ft, although other lengths may be selected as desired.

In operation, the core sampler tube 48 is connected, either directly or through one or more spacer tubes 40, to the rotary coupler shaft 14. Water is supplied to the delivery passageways 26, 46 and 50 by operation of control valve 22' when the cutters 54 are placed in position for obtaining a core sample. The drill motor 10 is energized to rotate the shaft and tube assembly. As the core sampler tube rotates and water is forced around the soil sample core C and delivered through the open end at cutters 54, the sub-surface material at the cutting surface is reduced to an aqueous slurry. Water wets and cools the cutting surfaces. The slurry of cuttings flows back up the annulus A adjacent the rotating tubes, to escape at the ground surface. The core sample C thus collected in the passageway 50 is retained by shoulder 52 as the tube is withdrawn from the ground.

It has been found that the core sampler of this invention is easily manipulated by a single person of average strength, to bore through soil, rock, logs and other sub-surface materials, with speed and facility. The core sampler is disassembled, by disconnection of the interconnected tubes and coupler shaft, for convenient transport to sites of operation.

It will be apparent to those skilled in the art that various changes may be made in the size, shape, type, number and arrangement of parts described hereinbefore, without departing from the spirit of this invention and the scope of the appended claims.

I claim:

1. A portable core sampler, comprising:

a) a hand-held motor providing a source of portable rotary power, b) a coupler shaft connected detachably at one end portion to the power source for rotation thereby and having a water delivery passageway in the opposite end portion, c) a water swivel member mounted on the coupler shaft for rotation relative thereto, d) coupling means for connecting a source of water to the water swivel member, e) passageway means in the water swivel member for conveying water to the water delivery passageway, f) an elongated hollow core sampler tube communicating at one end with the coupler shaft for rotation therewith and having a water delivery passageway communicating with the water delivery passageway in the coupler shaft, and g) core cutting means on the end of the hollow core sampler tube opposite the coupler shaft for cutting core samples.

2. A portable core sampler, comprising:

a) a source of portable rotary power, b) a coupler shaft connected detachably at one end portion to the power source for rotation thereby and having a water delivery passageway in the opposite end portion, c) a water swivel member mounted on the coupler shaft for rotation relative thereto, d) coupling means for connecting a source of water to the water swivel member, e) passageway means in the water swivel member for conveying water to the water delivery passageway, f) an elongated hollow core sampler tube communicating at one end with the coupler shaft for rotation therewith and having a water delivery passageway communicating with the water delivery passageway in the coupler shaft, g) core cutting means on the end of the hollow core sampler tube opposite the coupler shaft for cutting core samples, h) pin and slot connector means on adjacent ends of the coupler shaft and core sampler tube for securing said shaft and tube together detachably for simultaneous rotation, and i) safety pin and opening means on said coupler shaft and core sampler tube for locking said shaft and tube together releasably when the pin and slot connector means are connected together.

3. A portable core sampler, comprising:

a) a source of portable rotary power, b) a coupler shaft connected detachably at one end portion the power source for rotation thereby and having a water delivery passagway in the opposite end portion, c) a water swivel member mounted on the coupler shaft for rotation relative thereto, d) coupling means for connecting a source of water to the water swivel member, e) passageway means in the water swivel member for conveying water to the water delivery passageway, f) an elongated hollow core sampler tube communicating at one end with the coupler shaft for rotation therewith and having a water delivery passageway communicating with the water delivery passageway in the coupler shaft, g) core cutting means on the end of the hollow core sampler tube opposite the coupler shaft for cutting core samples, h) at least one elongated hollow spacer tube detachably interconnecting the coupler shaft and core sampler tube, i) pin and slot connector means on adjacent ends of interconnecting tubes for securing said tubes together detachably for simultaneous rotation, and j) safety pin and opening means on adjacent connected tubes for locking said tubes together releasably when the pin and slot connector means are connected together.

4. A portable core sampler, comprising:

a) a source of portable rotary power, b) a coupler shaft connected detachably at one end portion to the power source for rotation thereby and having a water delivery passageway in the opposite end portion, c) a water swivel member mounted on the coupler shaft for rotation relative thereto, d) coupling means for connecting a source of water to the water swivel member, e) passageway means in the water swivel member for conveying water to the water delivery passageway, f) an elongated hollow core sampler tube communicating at one end with the coupler shaft for rotation therewith and having a water delivery passageway communicating with the water delivery passageway in the coupler shaft, g) core cutting means on the end of the hollow core sampler tube opposite the coupler shaft for cutting core samples, h) an inner shoulder in the hollow core tube adjacent the core cutting means for supporting a core sample in the core tube, i) at least one elongated hollow spacer tube detachably interconnecting the coupler shaft and core sampler tube, j) pin and slot connector means on adjacent ends of said interconnected members for securing said members together detachably for simultaneous rotation, and k) safety pin and opening means on adjacent connected members for locking said members together releasably when the pin and slot connector means are connected together.

* * * * *